US009496638B1

(12) United States Patent
Su et al.

(10) Patent No.: US 9,496,638 B1
(45) Date of Patent: Nov. 15, 2016

(54) CONNECTOR WITH HIGH CONTACT DENSITY

(71) Applicant: NEXTRONICS ENGINEERING CORP., New Taipei (TW)

(72) Inventors: Hou-An Su, Keelung (TW); Xiaofeng Duan, Hubei (CN); Hai-Wen Yang, Baoji (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 14/985,891

(22) Filed: Dec. 31, 2015

(30) Foreign Application Priority Data

Aug. 10, 2015 (CN) ..... 2015 2 0596566 U

(51) Int. Cl.
*H01R 24/00* (2011.01)
*H01R 13/502* (2006.01)
*H01R 13/02* (2006.01)

(52) U.S. Cl.
CPC ..... *H01R 13/502* (2013.01); *H01R 13/02* (2013.01)

(58) Field of Classification Search
CPC .... H01R 13/502; H01R 13/02; H01R 23/72; H01R 23/727
USPC ..... 439/65–67, 352, 660
See application file for complete search history.

(56) References Cited

U.S. PATENT DOCUMENTS 5,215,471 A * 6/1993 Reymond ..... H01R 12/58 439/341
5,366,380 A * 11/1994 Reymond ..... H01L 24/72 257/E23.078
7,887,336 B2 * 2/2011 Nikaido ..... H01L 23/49827 439/591
8,172,591 B2 * 5/2012 Wertz ..... H01R 12/718 439/246
2004/0029411 A1 * 2/2004 Rathburn ..... H01L 23/49811 439/66

* cited by examiner

*Primary Examiner* — Khiem Nguyen
(74) *Attorney, Agent, or Firm* — Li & Cai Intellectual Property (USA) Office

(57) ABSTRACT

A connector with high contact density includes interior casing, first contact set, exterior casing, second contact set, and conducting element. The interior casing has a plug portion and a first slope. The first contact set is disposed in the first slope of the interior casing, and the first contact set has a plurality of first contact points. A containing space is formed inside the exterior casing, and the containing space is formed with a second slope, a second contact set is disposed in the second slope and has a plurality of second contact points. A conducting element includes an insulating main body and connecting terminals. The connecting terminals are disposed in the insulating main body and exposed to the exterior and interior of the insulating main body. The plug portion inserts into the containing space, so the first contact points contact the second contact points by the connecting terminals.

10 Claims, 7 Drawing Sheets

CONNECTOR WITH HIGH CONTACT DENSITY

BACKGROUND OF THE INVENTION

1. Field of the Invention

The present invention is related to a connector, in particular, to a connector with high contact density.

2. Description of Related Art

The prior art connector is utilized to connect wire, printed circuit board and other electronic elements, and is widely used in all kinds of electric devices. In general, the conventional connector contacts to another device by a plate-like mechanism, and a plurality of contact points are formed in the surface of the plate-like mechanism along the X or Y longitude, such as a USB type connector. However, the quantities of the contact points are limited and it is difficult to increase the density of the distributions of the contact points.

In summary, the inventor of this instant disclosure has contributed to research and developed the connector of the instant disclosure to overcome the abovementioned drawbacks.

SUMMARY OF THE INVENTION

The object of the instant disclosure is to provide a connector with high contact density. The connector of the instant disclosure provides a contacting manner by a three dimensional mechanism, and a plurality of contact points are distributed along the Z longitude so as to increase the density of the contact points.

According to one exemplary embodiment of the present invention, a connector with high contact density includes an interior casing having a first end and a second end, and a plug portion is formed in the interior casing between the first end and the second end. The outer surface of the plug portion is formed with a first slope. A first contact set is disposed in the first slope of the interior casing, the first contact set comprises a plurality of first contact points. An exterior casing has a third end and a forth end, and a containing space is formed in the interior of the exterior casing between the third end and the fourth end. The third end is formed with an opening, and the containing space connects with the opening. A second slope is formed in the interior of the containing space. A second contact set is disposed on the second slope of the exterior casing and has a plurality of second contact points. A conducting element has an insulating main body and a plurality of connecting terminals. The connecting terminals are disposed in the insulating main body and exposed to the exterior and interior of the insulating main body. The plug portion is inserted into the containing space, so the first contact points contact the second contact points by the connecting terminals.

The instance disclosure has the following advantages:

The connector with high contact density includes an interior casing, a first contact set, exterior casing, a second contact set, and a conducting element. The interior casing has a plug portion, the exterior of the plug portion is formed with a first slope, and the first contact set is disposed in the first slope. The containing space is formed in the interior of the exterior casing, and a second slope is formed in the interior of the containing space. The second contact set is disposed in the second slope of the exterior casing. The first contact points of the first contact set contact the second contact points of the second contact set by the connecting terminals of the conducting element. That is, the connector with high contact density of the present invention provides a three dimension mechanism, and the contact points are distributed along the Z longitude, and the quantities of the contact points are more than the prior art connector with plate-like structure.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

Figure 1:
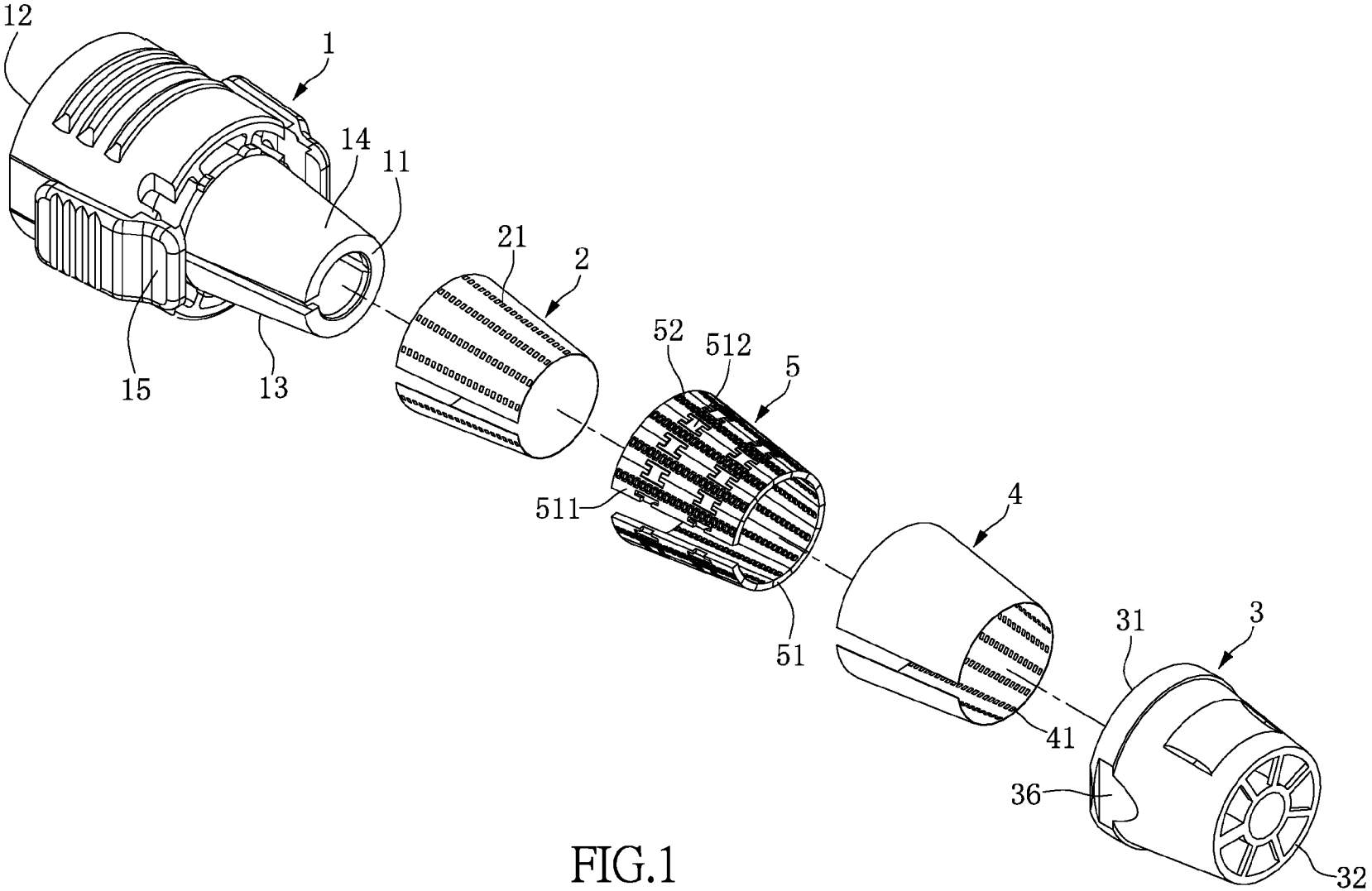
FIG. 1 illustrates an exploded view of a connector with high contact density in the instant disclosure.
Figure 2:
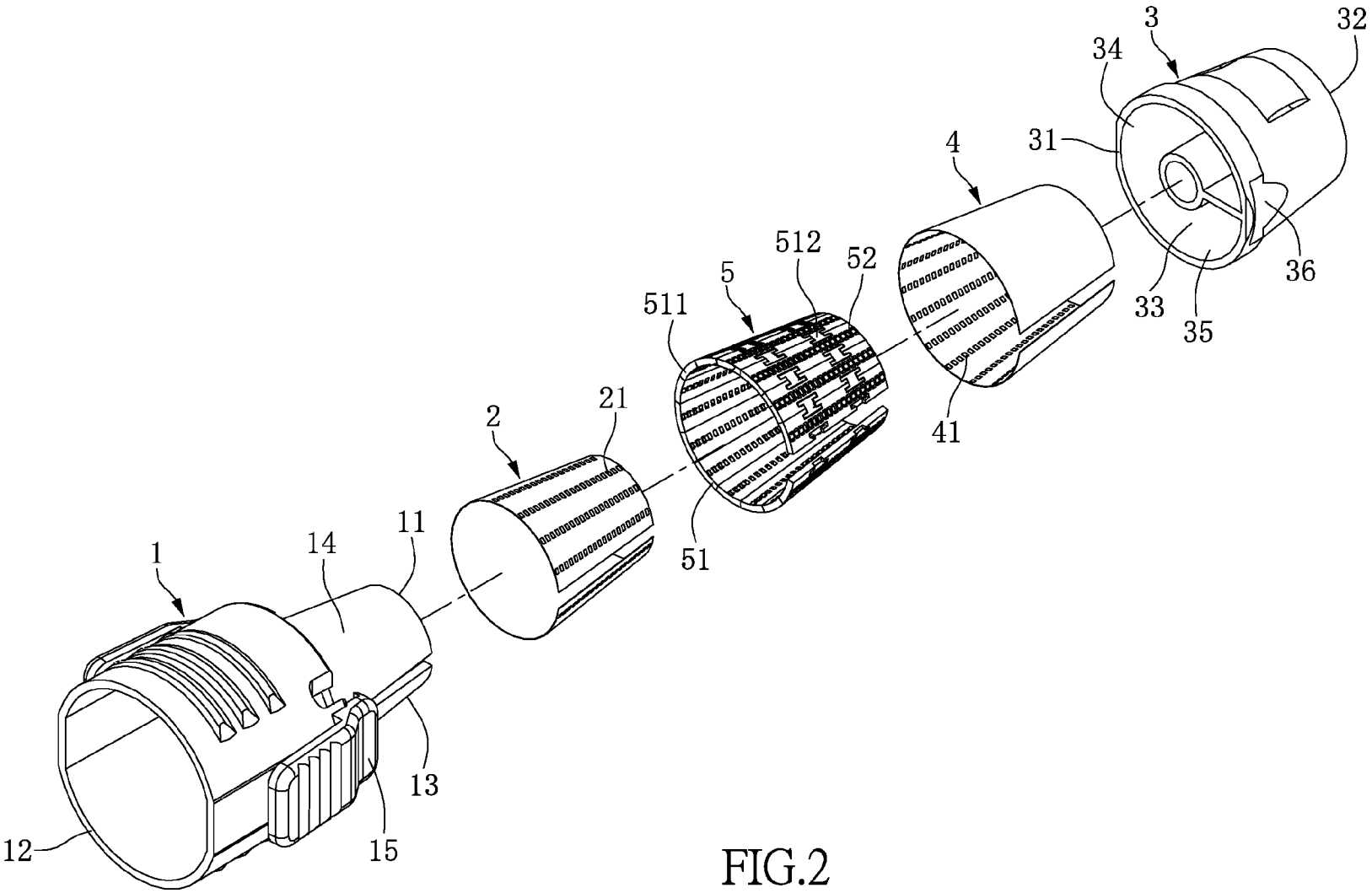
FIG. 2 illustrates another exploded view of a connector with high contact density in the instant disclosure.
Figure 3:
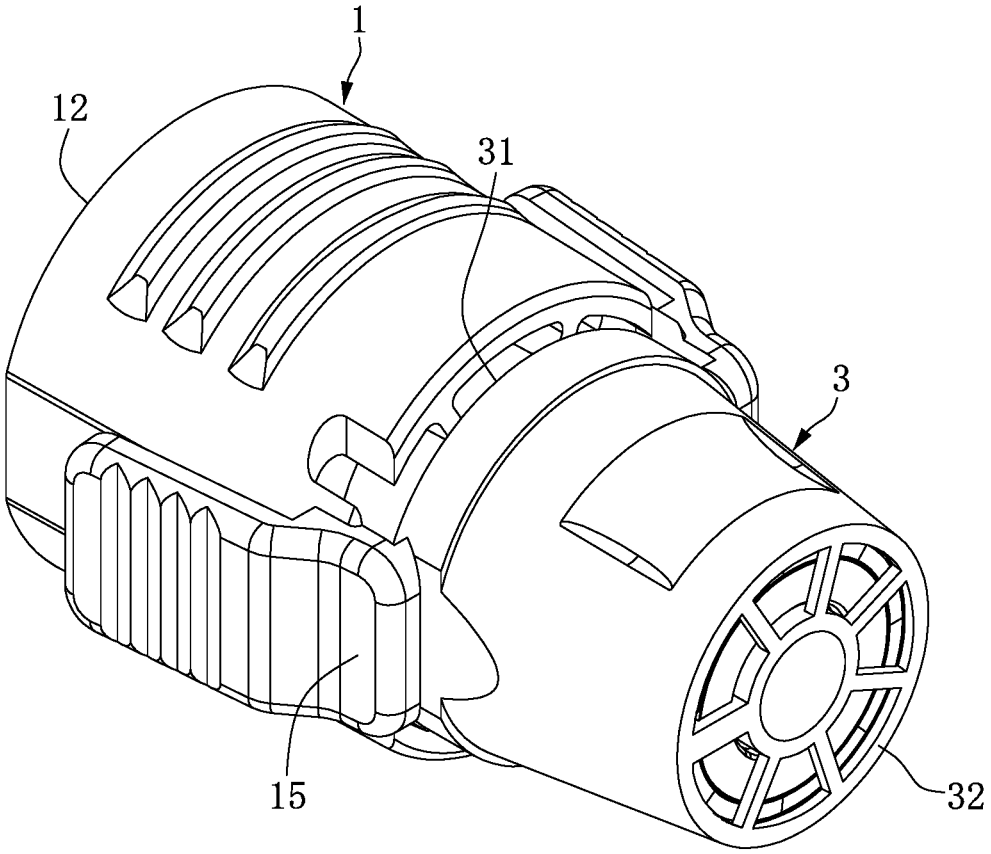
FIG. 3 illustrates a perspective view of a connector with high contact density in the instant disclosure.
Figure 4:
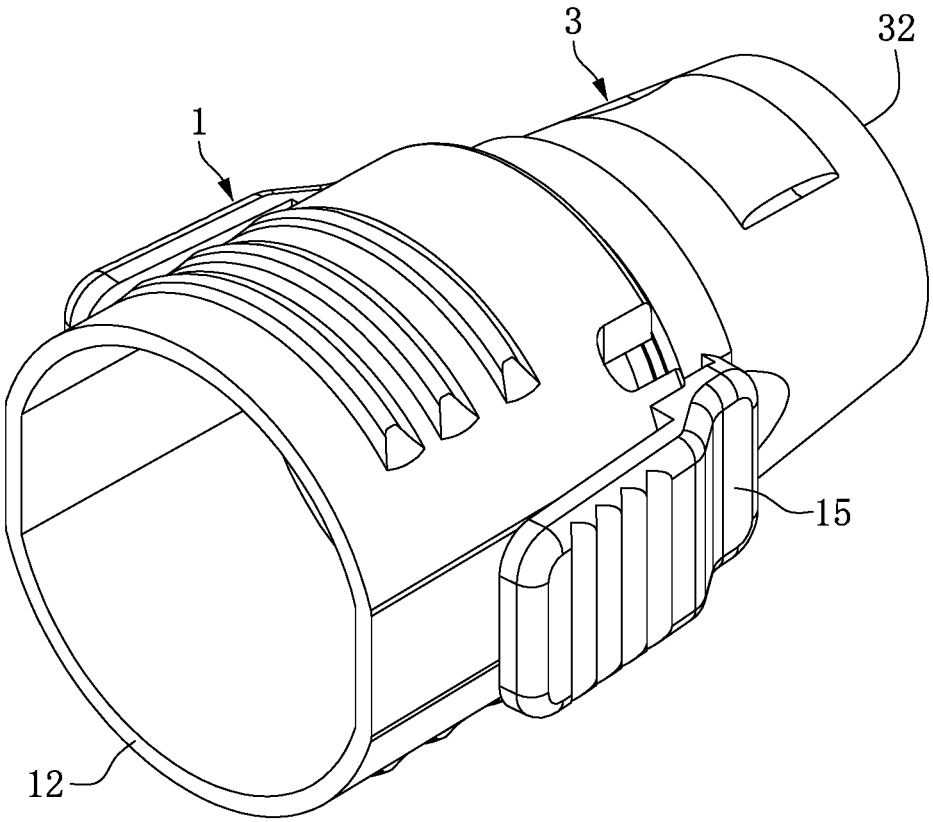
FIG. 4 illustrates another perspective view of a connector with high contact density in the instant disclosure.
Figure 5:
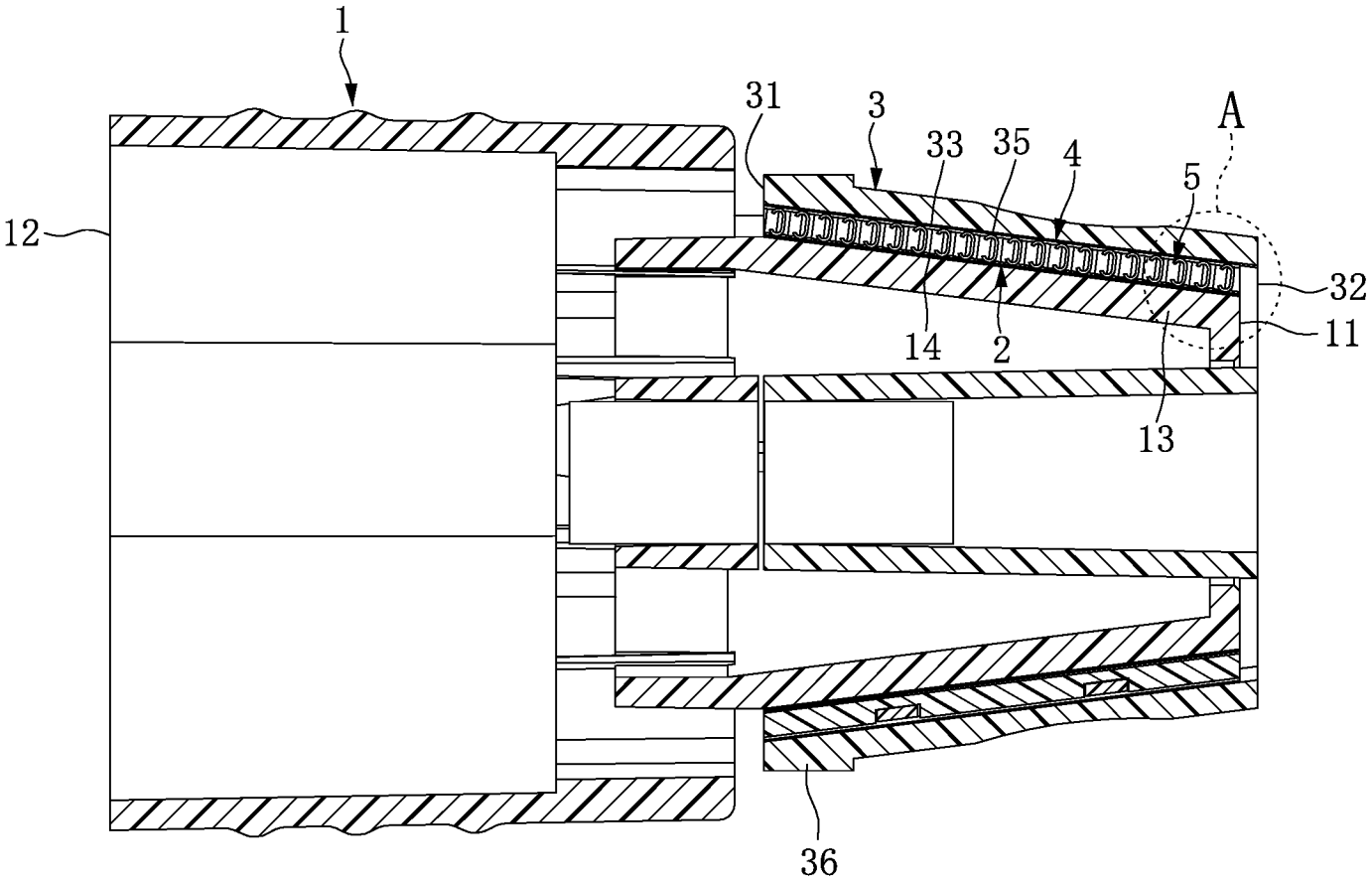
FIG. 5 illustrates a section view of a connector with high contact density in the instant disclosure.

With reference to FIG. 1-5, the instant disclosure provides a connector with high contact density, includes an interior casing 1, a first contact set 2, an exterior casing 3, a second contact set 4, and a conducting element 5.

The interior casing 1 is made of but not limited to insulating material (e.g. plastics). The interior casing 1 has a first end 11 and an opposite second end 12. The interior casing 1 is formed with a plug portion 13, the plug portion 13 is located between the first end 11 and second end 12 and adjacent the first end 11. The exterior of the plug portion 13 is formed with a first slope 14, and the first slope 14 is with but not limited to a plate-like slope shape or a cone-like slope shape. In this embodiment, the plug portion 13 is with a cone-like shape, the first slope 14 is formed in the exterior of the cone-like plug portion 13, the outside diameters of the plug portion 13 are increasing from the first end 11 towards the second end 12. The interior casing 1 further comprises a first clamping portion 15.

The first contact set 2 is disposed on the first slope 14 of the interior casing 1, and the first contact set 2 may be, but not limited to, FPC (Flexible Print Circuit) or wire cooperated with contact points. In this embodiment, the first contact set 2 is FPC with a plate-like shape and could be bent to the shape corresponding to the first slope 14 and available to dispose on the first slope 14. The first contact set 2 is fixed to the first slope 14 by the manners of bonding, buckling or screwing. The first contact set 2 has a plurality of wire and contact points (not shown), in other words, the first contact set 2 includes a plurality of first contact points 21 made of conductive electrical metal or alloy. The quantities and arrangement of the first contact points 21 are not limited and could be modified as required. The first contact point 21 exposes to the exterior of the first contact set 2, so the conducting element 5 is electrically connected to the second contact set 4. The first contact set 2 may also connect to the wire or printed circuit board as needed.

The exterior casing 3 is made of but not limited to the insulating material (e.g. plastics). The exterior casing 3 has a third end 31 and an opposite fourth end 32. A containing space 33 is formed inside the exterior casing 3 and between the third end 31 and the fourth end 32. An opening 34 is formed in the third end 31, and the containing space 33 connects to the opening 34. A second slope 35 is formed in the interior of the containing space 33, and the second slope 35 is with but not limited to a plate-like slope, or cone-like slope. In this embodiment, the containing space 33 is a cone-like hole, and the second slope 35 is with corresponding cone-like slope and formed in the interior of the containing space 33 with a cone-like hole, the outside diameter of the containing space 33 is decreasing from the third end 31 towards the fourth end 32. The inclination of the second slope 35 is corresponding to the inclination of the first slope 14. The outside surface of the exterior casing 3 is formed with a second clamping portion 36 corresponding to the first clamping portion 15. The interior casing 1 plugs into the exterior casing 3, and the interior casing 1 steadily fixes to the exterior casing 3 by the engagement of first clamping portion 15 and the second clamping portion 36.

The second contact set 4 is disposed on the second slope 35 of the exterior casing 3, and the second contact set 4 may be but is not limited to FPC (Flexible Print Circuit), or wire cooperated with contact points. In this embodiment, the second contact set 4 is FPC with a plate-like shape and could be bent in the shape corresponding to the shape of the second slope 35 and available to dispose on the second slope 35. The second contact set 4 is fixed to the second slope 35 by the manners of bonding, buckling or screwing. The second contact set 4 has a plurality of wire and contact points (not shown), in other words, the second contact set 4 includes a plurality of second contact points 41 made of conductive electrical metal or alloy. The quantities and arrangement of the second contact points 41 are not limited and could be modified as required. The second contact points 41 expose to the interior of the second contact set 4, so the conducting element 5 is electrically connected to the first contact point 21 of the first contact set 2. The second contact set 4 may also connect to the wire or printed circuit board as needed.

Figure 6:
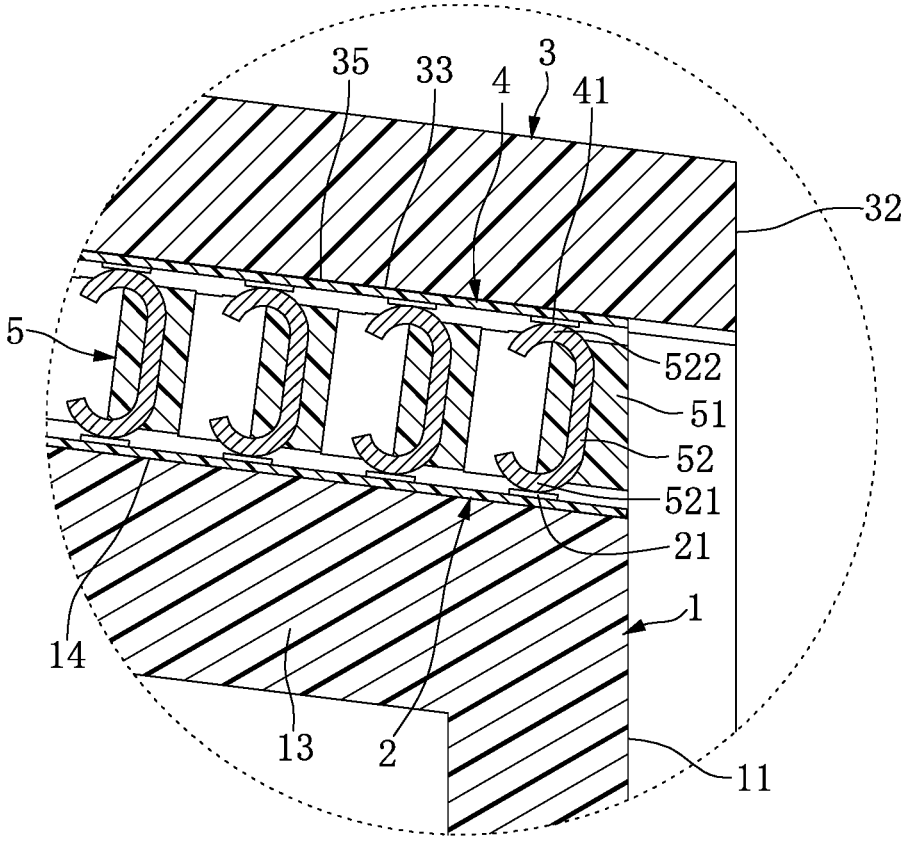
FIG. 6 illustrates an enlarged view of area A of FIG. 5.
Figure 7:
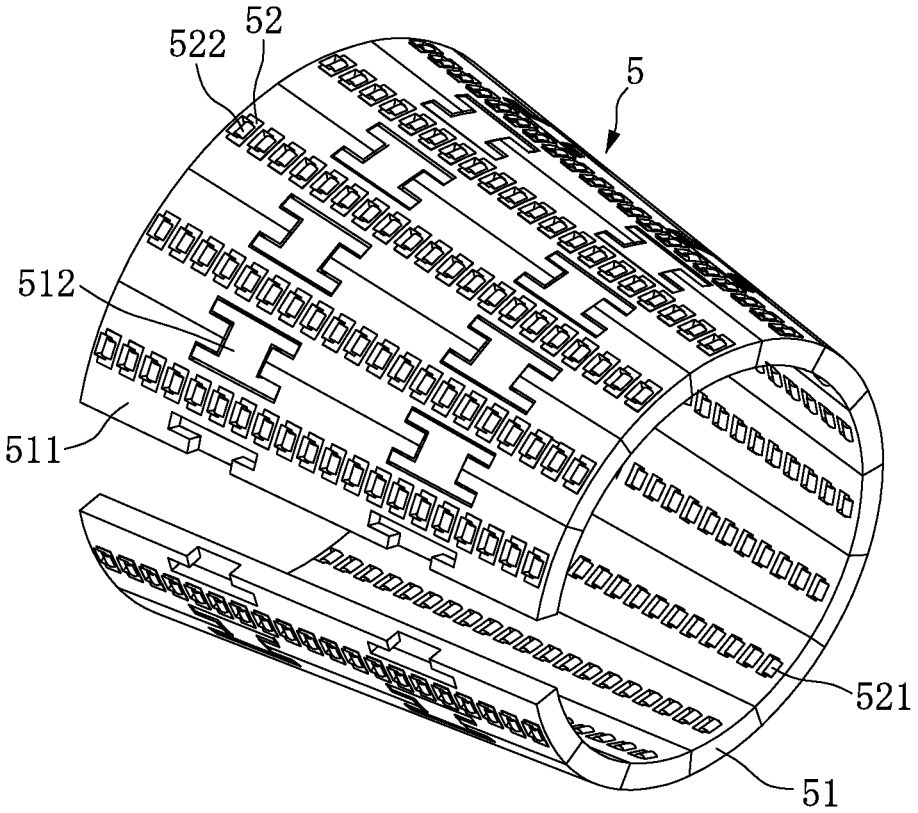
FIG. 7 illustrates a perspective view of a conducting element of a connector with high contact density in the instant disclosure.

The conducting element 5 is a two way conductive unit and provided between the first slope 14, the first contact set 2, second slope 35 and the second contact set 4. The conducting element 5 is used to conduct the first contact set 2 and the second contact set 4. The conducting element 5 includes an insulating main body 51 and a plurality of connecting terminals 52 (as shown in FIG. 6, 7). The insulating main body 51 is made of, but not limited to, insulating material (e.g. plastics). In this embodiment, the insulating main body 51 is formed in a hollow cone, and the inclination of the insulating main body 51 is corresponding to the inclination of the first slope 14 and the second slope 35.

The insulating main body 51 is molding in one or assembled by a plurality of small plates. In this embodiment, the insulating main body 51 is assembled by a plurality of plates 511 with a curved shape, and fasteners 512 are utilized to bond the plates 511 to each other, so the insulating main body 51 is with a hollow cone-like shape. The outer diameter and the length of the insulating main body 51 could be increasing or extending according to the need of quantity of the contact points.

The connecting terminals 52 are provided on the insulating main body 51, the connecting terminals 52 are made of conductive electrical metal or alloy. The shape, quantities, and the arrangement of the connecting terminals 52 are not limited and could be modified as required. The connecting terminals 52 are exposed to the interior and exterior of the insulating main body 51 and correspond to the first contact points 21 and the second contact points 41, so the conducting element 5 electrically contacts the first contact set 2 and the second contact set 4.

More specifically, each of the connecting terminals 52 has a first contact portion 521 and a second contact portion 522. In this embodiment, the connecting terminal 52 is bent into a C shape, and the first contact portion 521 and the second contact portion 522 are formed adjacent the two ends of the connecting terminal 52. The first contact portion 521 exposes to the interior of the insulating main body 51, whereas the second contact portion 522 exposes to the exterior of the insulating main body 51. The first contact portion 521 is corresponding to the first contact point 21, and the second contact portion 522 is corresponding to the second contact point 41, so the first contact portions 521 of the connecting terminal 52 contact the first contact points 21, and the second contact portions 522 of the connecting terminal 52 contact the second contact points 41.

The conducting element 5 contacts the first contact set 2 and the second contact set 4 by the manner of rotating or compression. Namely, when the plug portion 13 inserts into the containing space 33, the interior casing 1, the first contact set 2, exterior casing 3, second contact set 4, and the conducting element 5 contact to each other by manner of rotating, so the first contact portions 521 of the connecting terminal 52 contact the first contact points 21, and the second contact portion 522 of the connecting terminal 52 contact the second contact point 41, so the first contact points 21 contact the second contact points 41 by the connecting terminal 52. The interior casing 1, the first contact set 2, exterior casing 3, second contact set 4, and the conducting element 5 moves axially and contact to each other by manner of compression, so the first contact portions 521 of the connecting terminal 52 contact the first contact points 21, and the second contact portion 522 of the connecting terminal 52 contact the second contact point 41, so the first contact points 21 contact the second contact points 41 by the connecting terminal 52.

The connecting terminal 52 rubs the first contact point 21 and the second contact point 41 and so removes the oxide of the first contact point 21 and the second contact point 41 by the abovementioned rotating or compression process of the conducting element 5, and the connecting terminal 52 closely contacts the first contact point 21 and the second contact point 41.

The conducting element 5 contacts the first contact point 21 and the second contact point 41 by the manner of "one to one", "one to many", or "many to many". The conducting element 5 has a wire arrangement corresponding to the connecting terminals 52 of the conducting element 5 to meet the abovementioned use type.

In summary, a connector with high contact density of the present invention includes an interior casing, a first contact set, exterior casing, a second contact set, and a conducting element. The interior casing has a plug portion, the exterior of the plug portion is formed with a first slope, and the first contact set is disposed in the first slope. The plug portion is formed in the interior of the exterior casing, and a second slope is formed in the interior of the plug portion. The second contact set is disposed in the second slope of the exterior casing. The first contact points of the first contact set contact the second contact points of the second contact set by the connecting terminals of the conducting element. That is, the connector with high contact density of the present invention provides a three dimension mechanism, the contact points are distributed along the Z longitude, and the quantities of the contact points of the present invention are more than the prior art connector with plate-like structure.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A connector with high contact density, comprising:

an interior casing having a first end and a second end, a plug portion formed in the interior casing and between the first end and the second end, the outer surface of the plug portion formed with a first slope;

a first contact set disposed in the first slope of the interior casing, the first contact set comprising a plurality of first contact points;

an exterior casing having a third end and a fourth end, and a containing space formed in the interior of the exterior casing and between the third end and the fourth end, the third end formed with an opening, the containing space connected with the opening, and a second slope formed in the interior of the containing space;

a second contact set disposed on the second slope of the exterior casing and having a plurality of second contact points; and a conducting element having an insulating main body and a plurality of connecting terminals, the connecting terminals disposed in the insulating main body and exposed to the exterior and interior of the insulating main body, the plug portion inserted into the containing space, so the first contact points contact the second contact points by the connecting terminals.

2. The connector with high contact density according to claim 1, wherein the plug portion is with a cone shape, and the first slope is formed on the exterior of the cone shape plug portion, the outside diameters of the plug portion are increasing from the first end towards the second end, the containing space is with a cone shape, the second slope is formed in the interior of the cone shape containing space, the outside diameter of the containing space is decreasing from the third end towards the fourth end, and the insulating main body of the conducting element is formed with a hollow cone-like shape.

3. The connector with high contact density according to claim 1, wherein the first slope and the second slope are a plate-like structure.

4. The connector with high contact density according to claim 1, wherein the first contact set and the second contact set are printed circuit board, wires or electric contacts.

5. The connector with high contact density according to claim 1, wherein the first contact set is with a plate shape corresponding to the shape of the first slope.

6. The connector with high contact density according to claim 1, wherein the second contact set is with a plate shape corresponding to the shape of the second slope.

7. The connector with high contact density according to claim 1, wherein the insulating main body is molding in one.

8. The connector with high contact density according to claim 1, wherein the insulating main body is assembled by a plurality of plates, and the plates are bonded to each other by fasteners.

9. The connector with high contact density according to claim 1, wherein each of the connecting terminals has a first contact portion and a second contact portion, the first contact portion is exposed to the interior of the insulating main body whereas the second contact portion is exposed to the exterior of the insulating main body, the first contact portions of the connecting terminal contact the first contact points, and the second contact portions of the connecting terminal contact the second contact points.

10. The connector with high contact density according to claim 1, wherein the first contact set contacts the second contact set by the manner of rotating or compression.

* * * * *